US005933069A

United States Patent [19]

Huang

[11] Patent Number: 5,933,069

[45] Date of Patent: Aug. 3, 1999

[54] ELECTRICAL BREAKER

[76] Inventor: Albert Huang, No. 210-1, Hsing Nueng Rd., Tou Liu City, Yunlin Hsien, Taiwan

[21] Appl. No.: 09/161,123

[22] Filed: Sep. 25, 1998

[51] Int. Cl.[6] ..... H01H 71/16; H01H 61/00; H01H 31/74

[52] U.S. Cl. ..... 337/66; 337/59; 337/37; 337/345; 200/310; 200/313

[58] Field of Search ..... 337/56, 66, 76, 337/67, 79, 59, 36, 37, 85, 343, 333, 345, 362, 367; 200/310, 313

[56] References Cited

U.S. PATENT DOCUMENTS

| | | | |
|---|---|---|---|
| 2,911,503 | 11/1959 | Garbers | 337/56 |
| 3,358,099 | 12/1967 | De Bellomayre | 337/53 |
| 4,101,749 | 7/1978 | Josemans et al. | 200/317 |
| 4,363,016 | 12/1982 | Unger | 337/56 |
| 4,833,439 | 5/1989 | Bowden et al. | 337/68 |
| 4,937,548 | 6/1990 | Sdunek | 337/70 |
| 5,012,495 | 4/1991 | Munroe et al. | 337/3 |
| 5,079,530 | 1/1992 | Tsuchiyama | 335/17 |
| 5,262,748 | 11/1993 | Tsung-Mou | 337/66 |
| 5,539,371 | 7/1996 | Yu | 337/66 |
| 5,694,106 | 12/1997 | Wang | 337/79 |

FOREIGN PATENT DOCUMENTS

| | | | |
|---|---|---|---|
| 000647094 | 12/1984 | Switzerland | H01H 71/54 |

*Primary Examiner*—Leo P. Picard
*Assistant Examiner*—Anatoly Vortman
*Attorney, Agent, or Firm*—William E. Pelton, Esq.

[57] ABSTRACT

An electrical breaker includes a casing with a pushbutton pivotally connected to the top thereof, an alloy plate extending from one of two inside walls of the casing and connected to a first prong extending from the casing, a push member and an L-shaped member pivotally connected to the first end of the pushbutton, a biasing member biasing the push member to let the protrusion of the push member press against the other inside wall which has a recess defined therein. The distal end of the alloy plate is pushed by the push member to contact the second prong when the first end of the pushbutton is pushed, and the distal end of the alloy plate is disengaged from the second prong by the horizontal portion of the L-shaped member when an overload current passes through the alloy plate which curves to push the first end of the pushbutton upwardly.

6 Claims, 4 Drawing Sheets

ELECTRICAL BREAKER

FIELD OF THE INVENTION

The present invention relates to a electrical breaker, and more particularly, to an improved electrical breaker wherein the opened and closed positions of the alloy plate are accurately and stably maintained so that the alloy plate will not change its position abnormally.

BACKGROUND OF THE INVENTION

Conventional electrical breakers generally employ an alloy plate with one end thereof fixedly connected to a prong and the other end thereof disengagably contacting another prong. The alloy plate bends when it is subjected to a high temperature so that when an overload current passes through the alloy plate and a high temperature is generated, it bends and disengages from the contact point of the other prong and cuts the circuit. U.S. Pat. No. 5,262,748 and U.S. Pat. No. 3,846,729 each has an alloy plate which is indirectly connected to the pushbutton of the electrical breaker. Each of the alloy plate of these two breakers has a potential shortcoming in that they sometimes cannot be stably maintained in the closed and opened positions. That is to say, when in the opened position, the alloy plate could contact the contact point of the prong without pressing the pushbutton. This is because deficiencies exists in the structure between the pushbutton and the alloy plate so that after the breakers are used for a period of time, indefinite positioning of the alloy plate occurs.

The present invention intends to provide an electrical breaker wherein the alloy plate is pressed by a push member when in the closed position and supported by an L-shaped member connected to the pushbutton when in the opened position. Therefore, the two positions of the alloy plate can be positively maintained. The electrical breaker of the present invention has arisen to mitigate and/or obviate the disadvantage of conventional electrical breakers.

SUMMARY OF THE INVENTION

In accordance with one aspect of the present invention, there is provided an electrical breaker comprising a casing having an open top with the pushbutton pivotally received therein and a first prong and a second prong respectively extending from the bottom thereof. A recess is defined in the first inside wall of the casing and an alloy plate extends from the second inside wall opposite to the first inside wall and is connected to the first prong. The distal end of the alloy plate is disengagably connected to the second prong.

A push member is received in the casing and connected to the first end of the pushbutton. The push member has a protrusion and a biasing member that biases the pushing member toward the first inside wall so that the protrusion is received in the recess when the first end of the pushbutton is lifted and contacts the first inside wall when the first end of the pushbutton is pushed.

An L-shaped member is connected to the first end of the pushbutton and has a horizontal portion which supports the distal end of the alloy plate so that the distal end of the alloy plate is separated from the second prong when the alloy plate is subjected to an overload current and curves to push the first end of the pushbutton upwardly, and contacts the second prong when the first end of the pushbutton is pressed to compress the push member to push the distal end of the alloy plate to contact the second prong.

An object of the present invention is to provide an electrical breaker whose alloy plate is definitely positioned in opened and closed positions.

Further objects, advantages, and features of the present invention will become apparent from the following detailed description with appropriate reference to the accompanying drawings.

DETAILED DESCRIPTION OF THE PREFERRED EMBODIMENT

Figure 1:
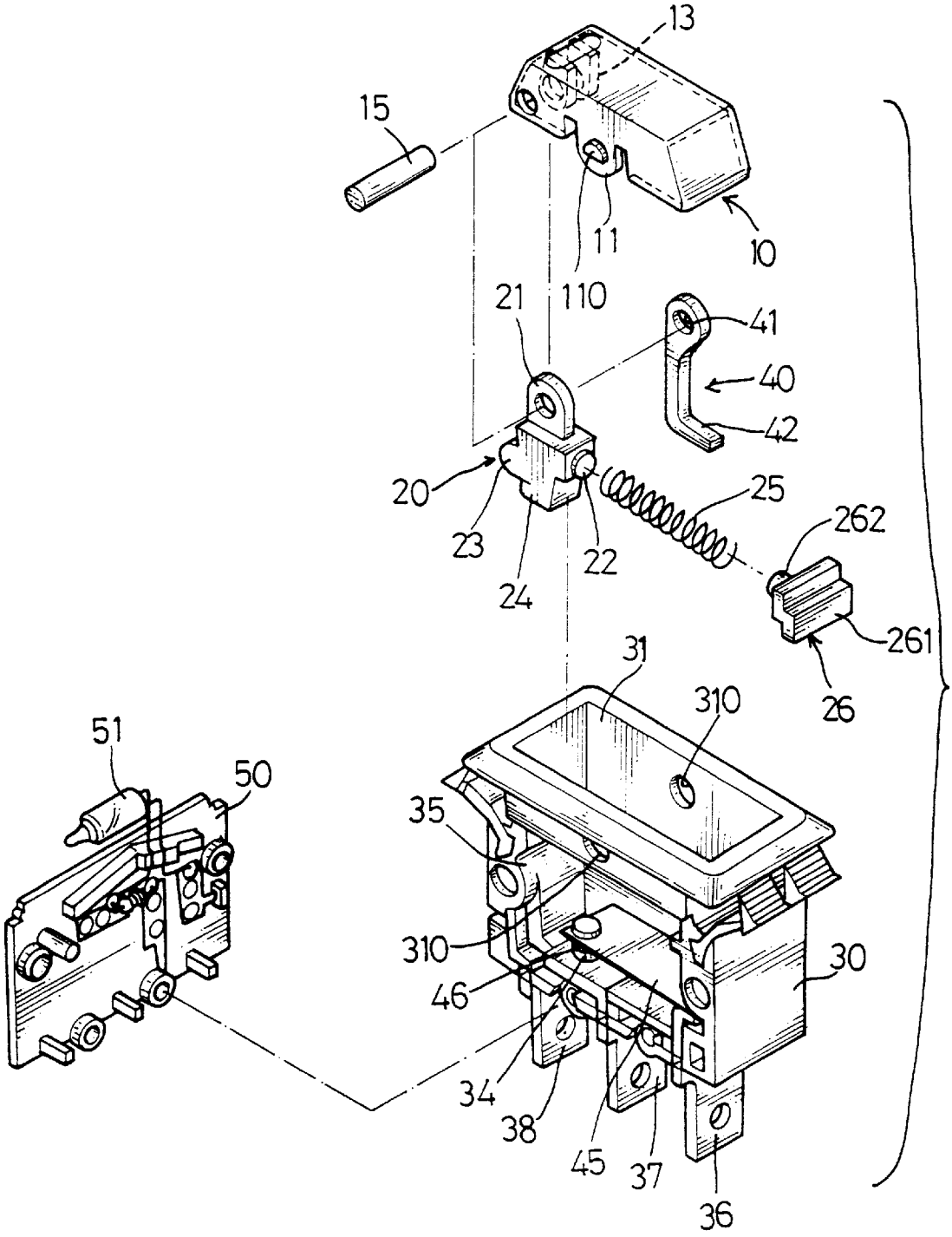
FIG. 1 is an exploded view of the electrical breaker in accordance with the present invention.
Figure 2:
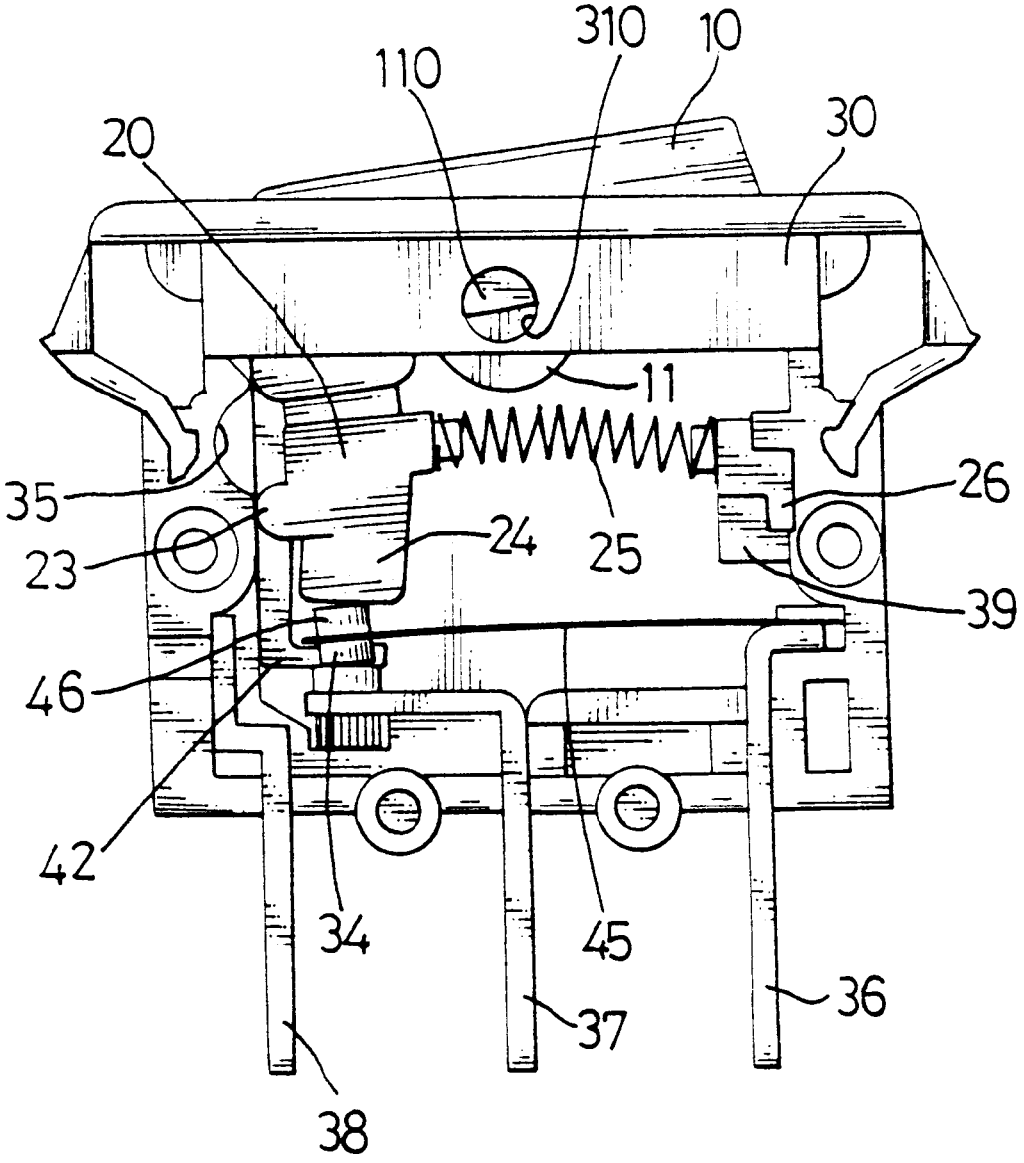
FIG. 2 is a side elevational view, partly in section, of the breaker in accordance with the present invention when the alloy plate is in the closed position.
Figure 3:
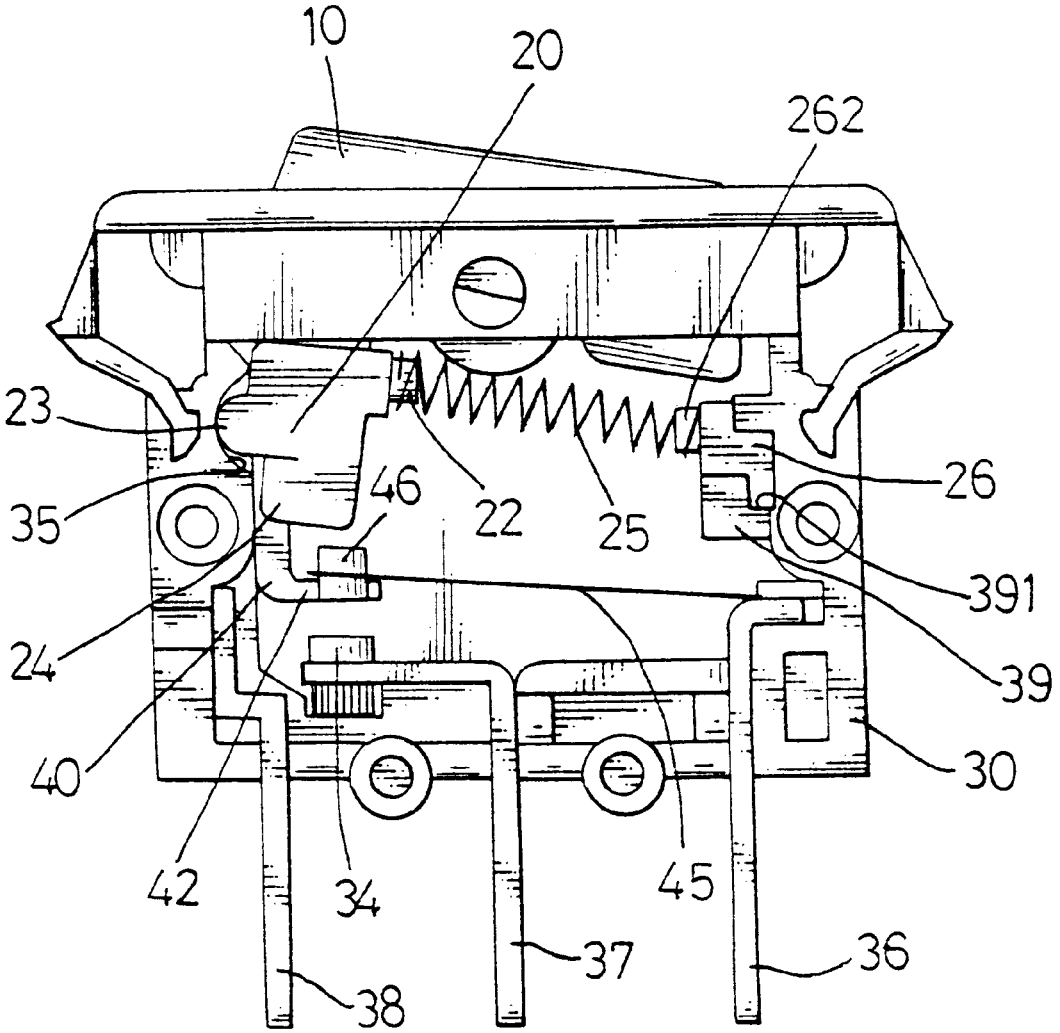
FIG. 3 is a side elevational view, partly in section, of the breaker in accordance with the present invention when the alloy plate is in the opened position.
Figure 4:
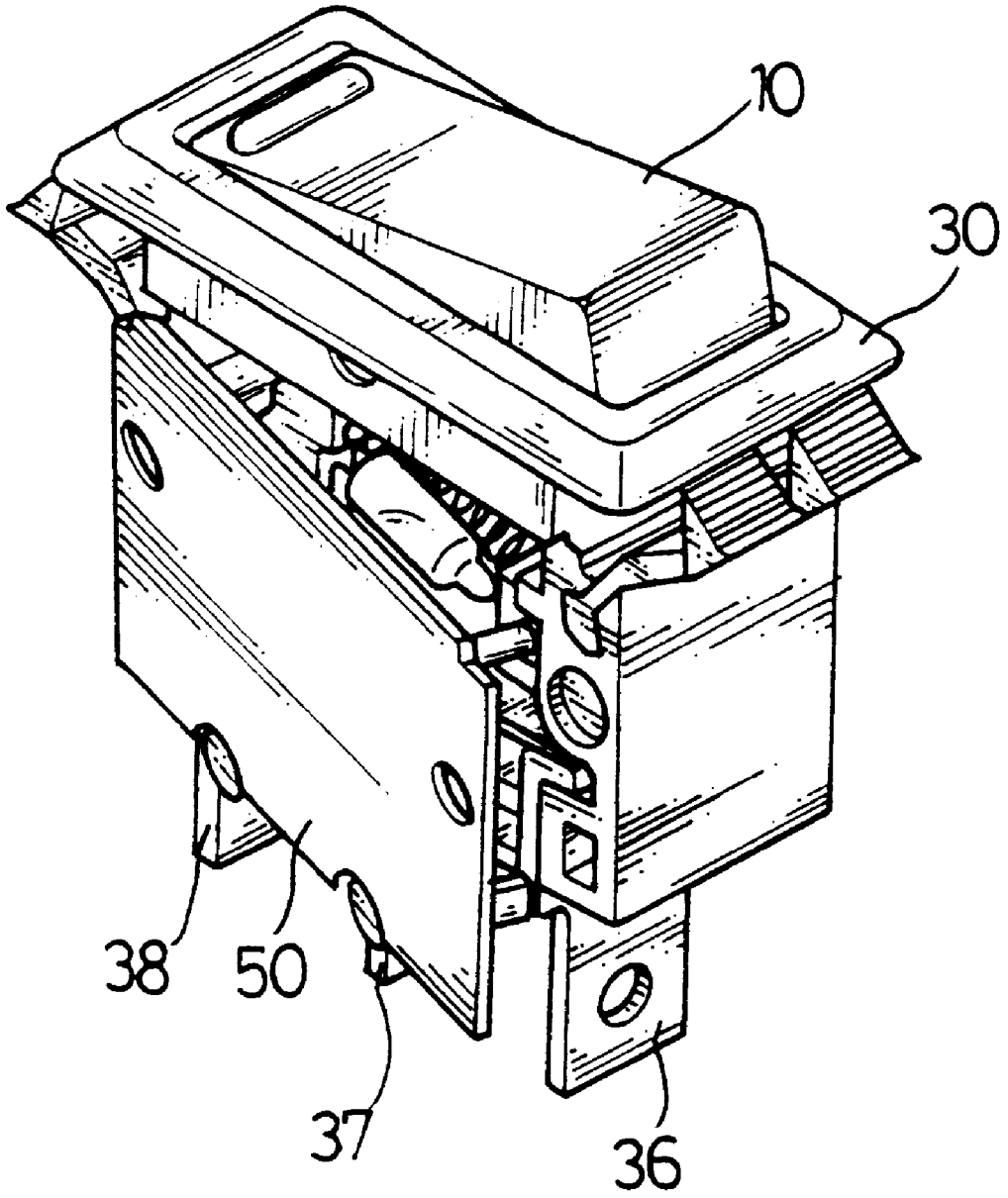
FIG. 4 is a perspective view of the breaker in accordance with the present invention to show a side member attached to the casing.

Referring to FIGS. 1 to 3, the electrical breaker in accordance with the present invention comprises a casing (30) having an open top (31) so as to pivotally receive the pushbutton (10) therein, a first prong (36), a second prong (37) and a third prong (38) respectively extending from the bottom thereof. A side cover (50), further referring to FIG. 4, is removably attached to the casing (30) and has electrical parts and an indication light (51) connected to the inside of the side cover (50). Two lugs (13) extend from the underside of the first end of the pushbutton (10) and two legs (11) respectively extend from the mediate portion of two sides of the pushbutton (10), wherein each of the legs (11) has a shaft (110) extending laterally therefrom. The casing (30) further has two apertures (310) defined through the two opposite sides thereof defining the open top so that the two shafts (110) are pivotally received in the two apertures (310).

A recess (35) is defined in the first inside wall of the casing (30) and a flange (39) extends from the second inside wall of the casing (30), wherein the second inside wall is located opposite to the first inside wall. A block (26) has an insert (261) extending therefrom and the flange (39) has a groove (391) defined therein so as to receive the insert (261) of the block (26). The block (26) has a first stub (262) extending therefrom.

A push member (20) is received in the casing (30) and has a first ring member (21) connected to the top thereof so that the first ring member (21) is pivotally received between the two lugs (13) of the first end of the pushbutton (10) by a pin (15). A protrusion (23) and a second stub (22) respectively extend from two opposite ends of the push member (20), and a pressing portion (24) extends from the bottom of the push member (20). A biasing member (25) is mounted between the first stub (262) and the second stub (22) so as to push the pushing member (20) contact against the first inside wall so that the protrusion (23) is received in the recess (35) when the first end of the pushbutton (10) is lifted, and removed from the recess (35) and contacts the first inside wall when the first end of the pushbutton (10) is pushed.

An L-shaped member (40) has a second ring member (41) connected to the top thereof so that the second ring member (41) is arranged adjacent to the first ring member (21) and both are pivotally received between the two lugs (13) by the pin (15).

An alloy plate (45) extends from the second inside wall opposite to the first inside wall having the recess (35) and is connected to the first prong (36). The distal end of the alloy plate (45) has a first contact point (46) and is disengagably connected to the second contact point (34) of the second prong (37). The L-shaped member (40) has a horizontal portion (42) which supports the distal end of the alloy plate (45) so that the distal end of the alloy plate (45) is separated from the second prong (37) when an overload current passes through the alloy plate (45) which curves to push the first end of the pushbutton (10) upwardly, and contacts the second prong (37) when the first end of the pushbutton (10) is pushed to compress the push member (20) to push the distal end of the alloy plate (45) to contact the second prong (37).

It is to be noted that a gap is defined between the horizontal portion (42) of the L-shaped member (40) and the distal end of the alloy plate (45) when the distal end of the alloy plate (45) is pressed by the push member (20) to contact the second prong (37). When the alloy plate (45) is in the opened position as shown in FIG. 3, the protrusion (23) is received in the recess (35) in the first inside wall and the distal end of the alloy plate (45) is supported by the horizontal portion (42) of the L-shaped member (40), this ensures that once the alloy plate (45) is in the opened position, the alloy plate (45) will not contact the second prong (37) unless the first end of the pushbutton (10) is not pushed.

Although the invention has been explained in relation to its preferred embodiment, it is to be understood that many other possible modifications and variations can be made without departing from the spirit and scope of the invention as hereinafter claimed.

What is claimed is:

1. An electrical breaker comprising:

a casing (30) having an open top and a first prong (36) and a second prong (37) extending from the bottom thereof, a recess (35) defined in the first inside wall of said casing (30), an alloy plate (45) extending from the second inside wall opposite to said first inside wall having said recess (35) and connected to said first prong (36), the distal end of said alloy plate (45) disengagably connected to said second prong (37);

a pushbutton (10) pivotally received in said open top (31) of said casing (30);

a push member (20) received in said casing (30) and connected to the first end of said pushbutton (10), said push member (20) having a protrusion (23) and a biasing member (25) biasing said pushing member (20) toward said first inside wall so that said protrusion (23) is received in said recess (35) when said alloy plate is subjected to an overload current and curves to push said first end of said pushbutton (10) upwardly, and contacts said first inside wall when said first end of said pushbutton (10) is pressed, and an L-shaped member (40) connected to said first end of said pushbutton (10) and having a horizontal portion (42) which supports the distal end of said alloy plate (45) so that the distal end of said alloy plate (45) is separated from said second prong (37) when said first end of said pushbutton (10) is lifted, and contacts said second prong (37) when said first end of said pushbutton (10) is pushed to compress said push member (20) to push the distal end of said alloy plate (45) to contact said second prong (37).

2. The breaker as claimed in claim 1 further comprising two lugs (13) extending from the underside of the first end of said pushbutton (10), said push member (20) having a first ring member (21) connected to the top thereof and said L-shaped member (40) having a second ring member (41) connected to the top thereof, and said first ring member (21) and said second ring member (41) pivotally received between said two lugs (13).

3. The breaker as claimed in claim 1 further comprising a block (26) connected to the second inside wall and having a first stub (262) extending therefrom, and said push member (20) having a second stub (22) extending therefrom so that said biasing member (25) is connected between said first stub (262) and said second stub (22).

4. The breaker as claimed in claim 3 further comprising a flange (39) extending from the second inside wall of said casing (30) and said flange (39) having a groove (391) defined therein, said block (26) having an insert (261) extending therefrom so as to be received in said groove (391) of said flange (39).

5. The breaker as claimed in claim 1, wherein said pushbutton (10) has two legs (11) respectively extending from the mediate portion of two sides thereof and each of said legs (11) has a shaft (110) extending laterally therefrom, said casing (30) having two apertures (310) defined through the two opposite sides thereof defining said open top so that said two shafts (110) are pivotally received in said two apertures (310).

6. The breaker as claimed in claim 1 further comprising a gap defined between said horizontal portion (42) of said L-shaped member (40) and the distal end of said alloy plate (45) when the distal end of said alloy plate (45) is pushed by said push member (20) to contact said second prong (37).

* * * * *